United States Patent [19]

Hill

[11] 4,083,491

[45] Apr. 11, 1978

[54] SYNTHETIC RAILROAD CROSSTIE

[75] Inventor: Albert A. Hill, Midland, Mich.

[73] Assignee: The Dow Chemical Company, Midland, Mich.

[21] Appl. No.: 605,793

[22] Filed: Aug. 18, 1975

[51] Int. Cl.[2] ..... E01B 3/44

[52] U.S. Cl. ..... 238/98; 238/54; 238/62; 238/82; 238/84; 238/100

[58] Field of Search ..... 238/54, 55, 56, 57, 238/58, 62, 63, 82, 83, 84, 95, 98, 100, 103, 109, 115, 116, 117, 118, 10 R, 10 A, 10 B, 10 C, 10 E, 10 F, 59, 60; 52/630

[56] References Cited

U.S. PATENT DOCUMENTS

| | | | |
|---|---|---|---|
| 511,227 | 12/1893 | Whipple | 238/54 |
| 567,632 | 9/1896 | Adams | 238/60 |
| 766,328 | 8/1904 | Crawford | 238/82 |
| 1,006,430 | 10/1911 | Buell | 238/118 X |
| 1,013,960 | 1/1912 | Seymour | 238/63 |
| 1,064,163 | 6/1913 | Pement et al. | 238/54 |
| 1,092,198 | 4/1914 | Allen | 238/59 X |
| 1,312,020 | 8/1919 | Davis | 238/100 X |
| 1,360,594 | 11/1920 | Snyder | 238/62 |
| 1,683,013 | 9/1928 | Arnold | 238/58 |
| 2,386,100 | 10/1945 | Ezell | 238/59 |
| 3,813,040 | 5/1974 | Heinemeyer | 238/84 |

*Primary Examiner*—Drayton E. Hoffman
*Assistant Examiner*—Randolph A. Reese
*Attorney, Agent, or Firm*—Lester J. Dankert; Tai-Sam Choo

[57] ABSTRACT

A railroad crosstie is constructed from at least two individually distinct rail support blocks interconnected by a web system which is fastened to the blocks and which comprises at least one self-supporting rigid sheet member adapted to be buried in the roadway ballast when the tie is in place. The blocks are selected to support and secure rails in conventional manner, and the interconnecting web system holds the blocks in relative position in the roadbed. The rigid sheet member adapted to be buried in the roadway ballast is advantageously disposed or provided with means such as horizontal longitudinal corrugations to interact mechanically with the particles of standard railroad ballast, whereby the tie resists being withdrawn from the roadbed. Exemplary ties have trapezoidal rail support blocks of cellular high density polyethylene interconnected with side panels of longitudinally corrugated steel sheet, which ties are lighter than standard wood ties but have comparable load properties and durability superior to wood.

5 Claims, 4 Drawing Figures

SYNTHETIC RAILROAD CROSSTIE

BACKGROUND OF THE INVENTION

This invention relates to railroad crossties and particularly to novel crossties advantageously replacing wooden ties conventionally used to support rails on a railway roadbed composed of particulate ballast.

Although wood ties have been and continue to be generally used in railroad track construction and maintenance, other materials have been sought and suggested for use particularly where the inherent characteristics of wood make wood ties unsatisfactory or where the scarcity or cost of suitable timber for wood ties makes substitute materials attractive. To this end, ties fabricated of concrete or of metal have been suggested. However, such ties are extremely heavy or awkward to use compared to wood ties, and concrete is brittle and nonresilient.

It has also been suggested to fabricate ties from synthetic plastic resin compositions. For example, ties fashioned from 20-lb/cu. ft. density polyurethane foam encased in an outer envelope of glass-reinforced polyester resin were described in a publication in "Modern Plastics", August, 1967, page 96. Ties constructed of cellular theremoplastic polymer, such as polyethylene, having density between about 20 and about 50 pounds per cubic foot, are described and claimed in U.S. Pat. No. 3,813,040 (May 28, 1974) to Ben W. Heinemeyer. These ties were designed to look like wood ties, i.e as generally rectangular blocks having the length, width and height of standard wood ties cut from natural logs.

Another synthetic tie, described and claimed in U.S. Pat. No. 3,416,727 (Dec. 17, 1968) to Benjamin P. Collins, is molded from a composition of pinewood resin modified phenol formaldehyde resin and shredded hardwood filler.

An object of this invention is to provide a new and advantageous crosstie for use in conventional railroad track systems, particularly to support and secure rails on a railway roadbed composed of particulate ballast such as crushed rock.

Another object is to provide such crossties which are lighter in weight and more durable than wooden ties but which have at least comparable holding power to maintain the rails in position on the roadbed.

Other objects and advantages of the new crossties will become apparent in the following description.

SUMMARY OF THE INVENTION

Accordingly, the invention provides new and advantageous railroad crossties of synthetic construction. The terms "tie", "crosstie", and "sleeper" are used interchangeably in the art and herein to mean the horizontal, transverse devices which secure and support rails on a railway roadbed usually comprised of particulate ballast.

In general, the new rail crosstie comprises at least two rail-support blocks and a web system interconnecting and secured to the blocks. Each block has a base face and a rail face, and is adapted to support at least one rail and to receive rail fastening devices on its rail face, such as rail plates, spikes, bolts, screws or the like. The blocks are separated from each other in the tie by distances corresponding to the distances separating the rails to be carried by that tie. Their respective base and rail faces are usually substantially aligned although the latter may be mutually canted in known manner. The web system comprises at least one self-supporting rigid sheet member or component adapted to be buried in the roadway ballast when the tie is in place, such member or component being capable of mechanically interacting with the ballast whereby the tie resists being withdrawn from the roadbed. In one group of embodiments, the tie comprises connecting side sheet members which are contoured, e.g. by corrugations in the sheet running lengthwise of the tie with undulations in the vertical profile.

In one aspect, the invention relates to a novel structure of rail tie which can be lighter in actual weight than a similar conventional wood tie. In another aspect, it relates to a novel combination of materials in a rail tie. Depending upon the choice of materials for the rail-support blocks and interconnecting web system, the new tie combines the advantageous properties of these materials over the property limitations of wood and, for example, improves the durability of the rail system in hostile environments. Also importantly, the new ties which are of synthetic construction have more uniformity than natural wood, yet allow wider choice of property specification and superior performance.

The drawings are not to scale, and the embodiments illustrated are subject to modification in view of the description that follows.

DETAILED DESCRIPTION AND EMBODIMENTS OF THE INVENTION

As indicated in the foregoing summary, the invention provides railroad ties of synthetic construction which in one aspect are characterized by novel structure and in another aspect by novel combination of materials, wherein at least two rail support blocks are interconnected with a novel web system.

Figure 1:
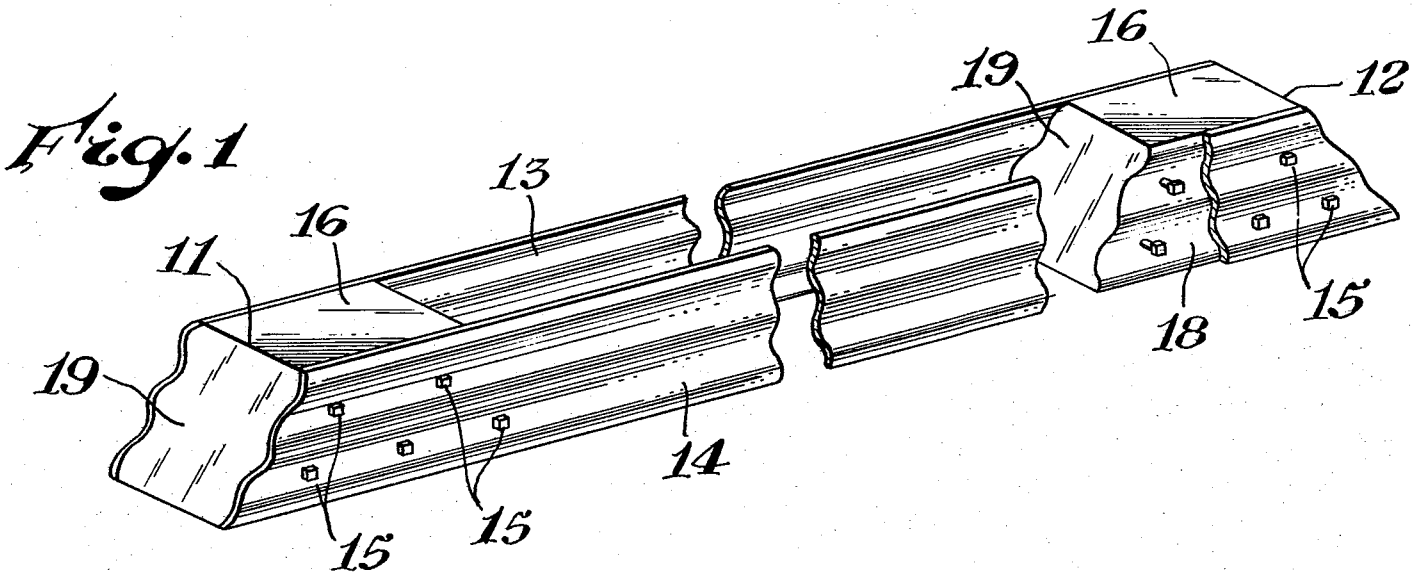
FIG. 1 of the drawing is an isometric sketch, partially cut away, of one embodiment of the new tie.

In the embodiment shown in FIG. 1 of the drawing, two rail support blocks 11 and 12 are interconnected with a web system in the form of side members or components 13 and 14 which overlap the corresponding side faces of blocks 11 and 12 and are fastened securely thereto by fasteners 15. In the embodiment shown, the side pieces 13 and 14 are corrugated lengthwise of the tie so that the vertical profile is undulate, and the side faces of the blocks are similarly contoured to match the shape of the overlying web pieces. As further shown by FIGS. 2*a* and 2*b*, each of blocks 11 and 12 has a rail support face 16, a base face 17, side faces 18 and end faces 19.

The rail-support blocks 11 and 12 are fabricated of any material suitable for supporting and securing a rail thereto. Particularly suitable are blocks made of cellular high density polyethylene, especially when reinforced with glass-fiber, the cellular material having apparent (bulk) density from about 15 to about 50 pounds per cubic foot (specific gravity from about 0.24 to about 0.8). Such material is hard, tough and resistant to deterioration by weather, by molds, fungi, bacteria and other naturally occurring organisms, and by chemicals occurring in the environment or lost from passing trains.

Track plates and rails can be secured to such cellular plastic blocks by conventionally driven spikes or by screws, bolts or other special fasteners. Because of their toughness and resistance to deterioration, the cellular polyethylene blocks hold the spikes securely against loosening by vibration or enlargement of the spike hole. Moreover, such blocks resist wear and cutting by the rail plate, and therefore reduce loosening and change of cant of the rail relative to the tie. In place of cellular polyethylene, other materials can be used in the rail support blocks, including, for example, other foamed polymers of ethylene and of propylene, rigid cellular plastic compositions such as those composed of polyurethanes, polyesters such as poly(1,4-butylene terephthalate), nylons, PVC resins, ABS resins, rubber-modified polystyrene resins, phenolic resins and the like. Also, shaped and cured mixtures of resinous and fibrous materials can be used as well as compositions with pigments, fillers, fibers and other reinforcements, and the blocks can be monolithic or made of a plurality of materials in laminated or coated form, or of a shell of one material around a core of another material, or in other configurations. The blocks can further be made of wood, laminated wood, laminated asbestos-cement boards, concrete or other materials.

Because, as is brought out below, the dimension of the rail-support blocks longitudinal of the tie is small relative to the whole tie length, these blocks can be made of wood from timber which is otherwise unsuited for making conventional full length ties. Also, a piece of tie timber that would make only one conventional tie can be used to make several ties of the present design. Further, blocks for the new ties can be cut from undamaged portions of used wood ties that are otherwise unsuited for further service. Although such ties of the present design using wood blocks have at least some of the shortcomings inherent in wood, the new design provides means to make better use of limited timber resources and to salvage used wood ties.

Figure 2B:
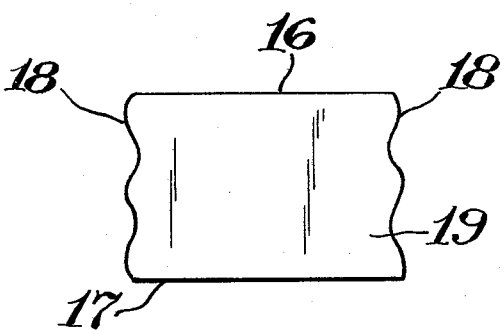
FIGS. 2*a* and 2*b* are elevation and end views, respectively, of one embodiment of rail support block as shown in FIG. 1.
Figure 2A:
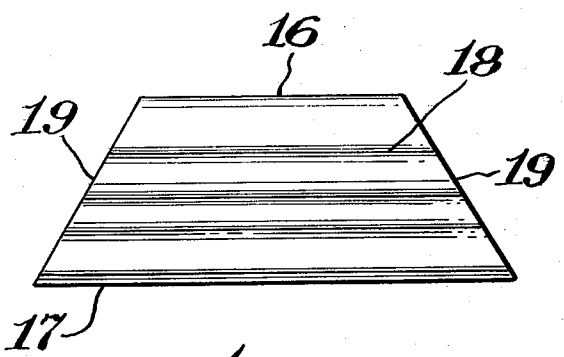

It is a feature of the present invention that the rail-supporting function of the new tie is provided by individually distinct rail-support blocks. Only so much of the material that is necessary to the rail-supporting function is provided in that tie in the form of such blocks, so that appreciable savings result over making an entire tie of such material. Thus, the area of the rail face 16 of the blocks shown in the drawing need be only large enough to accommodate the rail plates and allow for adjustment in position to align and gauge the rail or rails fastened thereto. The area of the base face 17 of the block as shown in the drawing may optionally be larger than the area of the rail face 16 in order to distribute the load over a larger portion of the ballast base of the roadbed. As shown in FIG. 1 and FIG. 2*a*, the side elevation profile of the rail support block can be trapezoidal. If desired, the optimum angle of end faces 19 to the base face 17 can be determined by vector analysis of the rail load forces and the modulus of the material in the rail support block. As shown in FIG. 1 and FIG. 2*b*, the side faces 18 of the rail support block are usually substantially parallel to each other, although they can also be angled outwardly and downwardly to provide a trapezoidal end profile and a broader dimension in the base face 17 than in rail face 16. In a typical embodiment of the rail support block shown in the drawing, the trapezoidal block is about 8 inches wide and 6 inches high, with the rectangular rail face 16 being 8 by 13 inches and the rectangular base face 17 being 8 by 23 inches, the total volume of the block being about 0.5 cubic foot. Of course, other shapes and sizes can be used.

Another feature of the present invention is the interconnecting web system connecting the rail support blocks in the new crosstie assembly. In the embodiment shown in FIG. 1 of the drawing, the web system is composed of two separate side pieces 13 and 14, each running the length of the tie and secured to the respective side faces of the rail support blocks 11 and 12. These web components can be of any relatively stiff material, metallic or non-metallic, such as steel, galvanized iron, controlled corrosion steel, aluminum alloy, thermoplastic resins, fiber-reinforced plastic such as glass-filled polyester or epoxy resin or fiber-filled phenolic resin, or asbestos-cement compositions, or resin-impregnated wood. In cases where the crosstie must be non-conducting in order to enable the rail system to be electrified, e.g. for signalization, the web system is preferably non-metallic and electrically non-conducting. Alternatively, the web system is arranged to be below the rail face of the rail support blocks which are themselves non-conducting; for example, as shown in the cross-sectional view of FIG. 3, the top face 16 of rail support block 16 can be substantially above the upper edge of the side components 13 and 14 of the web system so that a rail running transversely across the rail support block will be kept out of direct contact with the interconnecting web system.

One function of the web system, when the tie is in place in the roadbed, is to maintain the respective positions of the rail support blocks so as to maintain the gauge and alignment of the rails. Accordingly, the stiffness and strength of the material of the webs and the thickness, width and conformation of the webs are factors affecting the choice of web material and design from the standpoint of mechanical properties. In context of the web components, the terms relatively stiff, rigid and self-supporting mean that the component supports its own weight when a piece the length of the tie is held at only one end in a horizontal plane. Web components and design are preferably selected such that the assembled crosstie supports at least its own weight when held horizontally from one end.

The web system, such as side pieces 13 and 14 in FIG. 1, is secured to the rail support blocks by any means providing adequate strength in the assembly. Illustrated in FIG. 1 are fasteners 15 which can be nails, bolts, screws, staples or the like. Alternatively or additionally, adhesive bonds are employed at the common interfaces between the side faces of the rail support blocks and the side pieces of the web system, adhesion being provided by fusion of the block to the web side piece or by glue, cement or like adhesive interlayer. In yet other modes, metal web pieces are punched in the area of overlap with the block to provide a plurality of projecting tangs which are driven into the rail support block to provide attachment. Such fastening means is particularly advantageous with blocks of cellular high density polyethylene and like cellular plastics because the many tangs or prongs integral with the metal sheet distribute the stresses more widely through the joint, and the assembly is easily made with automatic and power equipment.

It is another feature of this invention that at least one sheet member of the web system, such as side pieces 13 and 14 in FIG. 1, is positioned to be buried in the roadbed and configured to interact mechanically with the particulate matter in the ballast of the road bed. Thus, in the embodiment shown, the web side pieces are corrugated with the straight line elements running lengthwise of the tie. When the tie is placed in the roadbed and ballast is packed in and around the tie, pieces of the ballast material, such as pieces of broken rock, intrude into the undulations of the corrugated web sheet and tend to "lock" the web and tie into the ballast. The consequence is to increase the force necessary to lift the tie vertically from the roadbed and to make its "effective weight" greater than its actual weight, whereby the tie in place behaves as though it were a heavy tie, thus providing a more stable track structure. Other means of providing engagement of the web components with the ballast can be used. The web sheet can have square, rectangular or saw-tooth corrugations rather than rounded sinuous ones, or ribs or other projections from the web and running lengthwise of the tie can be provided. In metal web components, holes can be punched to form projecting horizontal tabs with both holes and tabs interacting with the ballast material. Non-metallic web components can be fabricated by molding to provide the necessary ballast-engaging means, and thermoplastic resin sheets can be post-formed, e.g. by vacuum forming, to provide such means. Where it is desirable to enhance the resistance of the tie to side-slipping in the roadbed, the ballast-engaging means can include elements which are oriented cross-wise of the tie.

Figure 3:
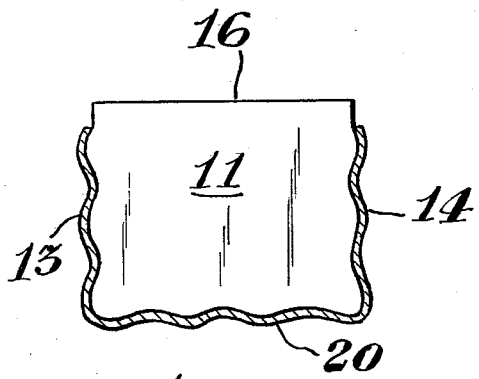
FIG. 3 is a sectional view of another embodiment of the new tie.

The web system can also consist of or include a web component running across the bottom of the tie. In one embodiment, the bottom web component is secured to the bottom faces of the rail support blocks in the same manner as hereinbefore described for the side web components. In such embodiment, the bottom web component can be a piece separate from the side pieces and, if sufficiently strong and stiff, the bottom web component interconnecting the rail support blocks and secured to the bottom faces thereof can be used as the only component of the interconnecting web system, i.e. without any side pieces. The construction of tie in which the only web component interconnecting the rail support blocks runs across the tops of the blocks does not interact with the ballast of the roadbed when the tie is in place and in use, does not attain the objects of this invention and is excluded. In other embodiments, the web system has both side and bottom pieces with the side pieces secured to the bottom piece or fabricated from a single piece into side and bottom portions. For example, as shown in FIG. 3, which is a sectional view taken across the web system between rail support blocks of such a tie, the web system contains side components 13 and 14 and bottom component 20 fabricated from a single piece of corrugated sheet bent along longitudinal lines to form an open top rectangular trough. In such embodiments, where a bottom component 20 is integral with the side components 13 and 14 of the web system, it is not necessary that the bottom component 20 be secured to the bottom faces of the rail support blocks, and the bottom component 20 may run longitudinally of the tie only in the space between ends of adjacent rail support blocks. Thus, in the embodiments shown by the sectional view of FIG. 3, the side components 13 and 14 of the web system extend over and are secured to the respective side faces of the rail support block 11 shown in end view. In optional alternative variations of such ties, the bottom component 20 of the web system can extend under and be secured to the bottom face of block 11, or can extend under the bottom face of block 11 without being secured thereto, or can be cut back so as not to extend under block 11.

If desired, the bottom component 20 of the web system can be corrugated crosswise of the tie, i.e. with the straight line elements of the corrugations running transverse of the tie, or otherwise provided with means to enhance the resistance of the tie to sideways slipping of the tie in the roadbed ballast. In like manner, the bottom or base faces of the rail-support blocks can be corrugated or provided with cleats, flanges or like means oriented transverse of the tie to engage the ballast and enhance the sideways stability of the track system.

In preferred embodiments, the rail support blocks are foamed polyethylene, and the interconnecting web system is bottomless, i.e., has only side components, or has a bottom component only in the space between adjacent blocks of the tie. In such ties, the bottom faces of the rail-support blocks are in direct contact with the ballast. Such condition is advantageous because the foamed polyethylene material responds to the pressure between the load and the ballast and conforms to the pieces of the ballast, and because vibrations between the load and the ballast are absorbed by the resilient plastic. In other words, the ballast particles indent and bite into the polyethylene foam thereby advantageously reducing shifting and sliding of the tie on the roadbed. Moreover, the resilient plastic block advantageously avoids grinding the ballast and thus minimizes fouling.

As shown by FIG. 1, the ends of the interconnecting web system can be trimmed flush to the outer ends of the rail support blocks at the ends of the tie; alternatively, in embodiments not shown in the drawing, the web system can extend beyond the end blocks of the tie, if such configuration is desired. In still other embodiments, the web system does not extend to the extreme outer ends of the rail support block; for example the longitudinal side pieces are cut shorter than the overall length of the tie, provided that they overlap the sides of the end support blocks sufficiently to enable the assembly to be adequately secured together.

In FIG. 1 of the drawing, a tie in accordance with the invention is shown having two rail supporting blocks which would be separated from each other by distance corresponding to the distance between rails to be carried by that tie. If desired, three or more rail supporting blocks can be incorporated into the tie structure to provide special purpose ties where more than two rails are to cross and be secured to the tie. Alternatively, the rail support blocks can be made large enough to accommodate more than one rail on their rail face.

In the embodiments shown in the drawing, the side pieces of the web system interface with the sides of the rail-support blocks and are fastened thereto. In other embodiments, not shown, the web system comprises at least one sheet member adapted to interact mechanically with the ballast but which is attached not directly to the rail support blocks but only indirectly thereto through other members of the interconnecting web system. For example, side sheets similar to sheets 13 and 14 of FIG. 1 are attached to devices such as rods or bars, not shown, which in turn are attached to blocks 11 and 12, e.g. to the top, bottom, side or otherwise, in manner not shown. In such embodiments, the "side sheet" is not required to be in interface contact with the sides of the rail support blocks; in some such embodiments the side sheets are separated from the blocks and/or are at an angle thereto. Also, such sheet which is attached to the blocks indirectly through other members of the web system is not necessarily a side sheet, but can be disposed between the rail support blocks provided it is placed in the tie in position such that the sheet is buried in the ballast and mechanically interacts therewith when the tie is in place in the roadbed.

In still other embodiments not shown in the drawing, the interconnecting web system comprises parts in the form of longitudinal members having diverse cross sections such as channel, angle, H, I, T, X or folded sheet sections. In some instances these are used to supplement the sheet members of the web system, e.g., to add strength or to provide means of fastening the sheets to rail support blocks. In other instances the web system consists essentially of a member having such cross section of which at least one element provides the necessary mechanical interaction with the ballast when the tie comprising that web system is in use. For instance, such ties are composed of rail support blocks interconnected with a longitudinal member having a channel section; where the middle portion of the channel is horizontal in the tie, such portion is selected to be wide enough to give good interaction with the ballast; when the edge flanges of the channel are horizontal in the tie, such flanges are made wide enough to give good interaction with the ballast. Similarly, with other sections such as angles, H, I or others, the portion which is to be horizontal in the tie when in use is made wide enough to interact with the ballast material in the roadbed.

In the case of ties made with interconnecting web system comprising longitudinal members having one of the diverse cross-sections just described or rods or bars or the like, the rail-support blocks can be provided with recesses or passageways of like section to accommodate the web member. Thus, in one such embodiment, rail-support blocks are provided with T-shaped openings in direction to be facing each other in the tie, the cut being open to the bottom face of the block. The blocks are placed on the ends of a light weight I-sectioned sheet metal beam fitting the T-slot in the blocks with the lower flange of the I section interfacing the bottom of the blocks. In one embodiment, the assembly is fastened through the lower flange of the connecting beam into the bottom of the blocks. In an alternative construction, the rail-support blocks are molded or cast from plastic material directly onto some part of the longitudinal interconnecting member which has first been provided with some transverse element or part which locks the molded-on block to the longitudinal member. Other means of assembling rail-support blocks with web systems having a sheet member adapted to be buried in and interact with the ballast to make crossties in accordance with this invention will be apparent to those skilled in the art in view of this description.

Many of the embodiments of new synthetic ties of this invention are capable of being assembled on the track or job site from components or subassemblies supplied thereto, using simple tools. Many of the web systems are designed to use parts which can be inserted beneath existing rails from work positions between the rails, thereby facilitating track repair and maintenance in tunnels and other crowded locations by installing the tie from between the rails.

In use, the new crossties are placed in a railway roadbed and fitted with rails. As usually constructed, the new tie does not have great "beam" strength because the interconnecting web system is usually not designed for that purpose. In such cases, it is important that the roadbed sub-base and base be good and firm under each rail line and that good clean ballast be used and properly tamped to set the ties, the ties being thus substantially embedded in the ballast so that the tops of the ties are nearly level with the top of the ballast. When so installed, the rail support blocks of the tie receive the load of the rail traffic and transmit and distribute the same through the ballast to the base of the roadbed. As indicated hereinbefore, the rails are secured with suitable devices in conventional manner to the rail support blocks of the tie in place. As with any tie, it is advantageous to use rail plates of a size and design to distribute traffic stresses from the rail to an adequate area of the tie surface, taking into account in known manner the expected load and speed of trains carried by the rails and the modulus of the material of the rail-support blocks, inter alia.

It is a feature of the present invention that, although the novel crossties can be quite light in actual weight, especially when constructed of cellular plastic rail support blocks and low density interconnecting webs, they behave in place as though they were considerably heavier, i.e. their apparent weight measured by force required to lift them from the ballasted position is comparable to conventional wood ties. This is because the novel web system interconnecting the rail support blocks interacts mechanically with the particulate ballast of the roadbed.

The examples that follow illustrate the invention but are not to be taken as limiting its scope.

EXAMPLE 1

Blocks of foamed polyethylene having closed cells were made from polyethylene having density 0.965 g/cm$^3$ and standard Melt Index 0.7 dg/min, compounded with about 3 weight percent carbon black as pigment and about 1 weight percent azodicarbonamide as blowing agent, by heating the composition to temperature above the melting point of the polymer and above the decomposition temperature of the blowing agent, placing the resulting foaming plastic mass into a mold, and allowing it to cool and to harden. The mold had rectangular bottom and top walls parallel to each other, parallel side walls normal to the top and bottom walls, and end walls normal to the side walls but angling in respect to bottom and top walls such that the periphery of the side walls was a symmetrical trapezoid. The trapezoidal side walls of the mold had sinuous corrugations running parallel to the parallel edges of the wall with about 1.25 inch wave length. The other walls were flat planes. The internal dimensions of the mold were such that the resulting molded blocks were about 7.5 inches high (between parallel rectangular faces) and about 8.5 inches wide (between corrugated faces), with one rectangular face (to be the rail face of the block) being about 8.5 by 14 inches and the other rectangular face to be the base of the block) being about 8.5 by 16 inches. The resulting molded cellular polyethylene blocks had average apparent density of about 37 pounds per cubic foot.

Prototype ties for laboratory testing were constructed from the above described blocks.

Test tie A was made using pieces of corrugated galvanized steel, nominal thickness 0.018 inch, 9 feet long parallel to the corrugations and 7.75 inches wide having corrugations matching those in the sides of the blocks described above. Two foam blocks were placed between two pieces of the corrugated steel, the blocks being spaced 59 inches apart, center to center, long bases down, with their corrugated sides in register with the corrugations of the steel pieces. In this test tie, the steel side pieces were adhered with commercial epoxy adhesive at the common interface with the foam blocks. Additionally, five small holes were drilled through the assembly, each passing through the foam block and through each side steel piece in direction generally normal to the sides, and threaded rods were run through the holes and fitted with washers and nuts tightened to secure the steel side panels to the foamed plastic blocks. In general, the resulting structure conformed to that depicted in FIG. 1 except that the corrugated sheet side panels extended beyond the outermost ends of the foamed plastic blocks.

Test tie B was made in manner similar to test tie A except hat, in place of the corrugated galvanized steel side pieces, there were used pieces of corrugated glass-reinforced polyester resin sheet, nominal thickness 0.040 inch, having the same shape of corrugation as the steel sheet of tie A, the pieces being 8 feet long parallel to the corrugations and 7.5 inches wide.

Test tie C was prepared from corrugated glass-reinforced polyester resin sheet having sinuous corrugations at about 2.5-inch wave length in pieces 9 feet long parallel to the corrugations and 8 inches wide. Since these corrugations did not match the spacing of those on the side faces of the foam plastic blocks, the side panels of the tie were fastened to the blocks by wrapping wide adhesive tape several times completely around the blocks and side panels to make an assembly that was temporary but suitable for testing described below.

For laboratory testing of the resistance provided by the described prototype ties to lifting from a typical ballasted railway roadbed, a test rig was constructed. In the test rig, the test tie was placed in a bed of ordinary railroad ballast of broken rock surrounding the tie to a level of the top of the tie, filling the space also between the foamed blocks and between the corrugated side panels. The ballast was thoroughly consolidated and settled by vibration to simulate conventional practice of tamping the ballast in building or reconditioning a rail line. The placement of the test tie was intended to simulate in the laboratory the installation of such a tie in railroad service except that no rails were fastened to the tie. Instead, apparatus was provided to lift the tie vertically up out of the surrounding ballast by means of straps passed around the tie near its ends, e.g. under each foam block, and connected to a lifting device equipped with load measuring instruments.

In a preliminary test, a railroad wood tie, 6 inches thick by 8 inches wide by 8 feet 4 inches long was tested. Its actual weight was 135 pounds. When placed in ballast and lifted upward in the manner just described, a lift-out force of 240 pounds was required.

The test ties hereinbefore described and identified as test ties A, B and C were weighed and tested in similar manner. Their actual weights and the force necessary to lift them from the ballast are shown in Table I.

Table I

| Test Tie | Actual Wt., lbs | Lift-Out Force, lbs |
|---|---|---|
| 1.A | 54 | 443 |
| 1.B | 48.5 | 375 |
| 1.C | 48.5 | 392 |

It will be seen that the test ties of this invention, although actually lighter than the wood tie used in the preliminary test, required a greater force to lift them from imbedment in railroad ballast.

EXAMPLE 2

In another series, test ties were constructed from foamed plastic blocks and galvanized corrugated steel sheet. The blocks were molded from polyethylene composition like that described in Example 1 using carbon black pigment and azodicarbonamide blowing agent and in similar manner but in a different mold so that the blocks were 8 inches wide (between the corrugated faces) and 6 inches high (between the top and bottom faces), the top face was 8 by 13 inches, and the bottom face was 8 by 23 inches. The resulting blocks had gross volume of about 0.5 cubic foot and apparent density of about 30 pounds per cubic foot. The side faces were molded with corrugations parallel to the top and bottom edges with the corrugations being made to match those of standard 2.5 inch corrugated steel.

Blocks as just described were assembled into test ties according to this invention using for the interconnecting web system pieces of standard galvanized corrugated steel sheet, 0.034 inch nominal thickness, having 2.5-inch corrugations.

In test tie D, two foam plastic blocks, 59 inches apart, center-to-center, were fastened to two pieces, one on each side of the blocks, of the corrugated steel sheet cut 8 feet long parallel to the corrugations and 6 inches wide, the ends of which extended beyond the outermost ends of the blocks. The side panels were fitted into the corrugated sides of the foam plastic blocks and secured in each instance with five lag bolts, 2 inches long, passing through holes in the steel panels and screwed directly into the body of the foamed plastic block. No adhesive bonding material was used.

Test tie E was constructed from the same materials and in the same manner as test tie D except that the ends of the steel side panels were trimmed off flush with the sloped outermost ends of the foam plastic blocks in the manner portrayed in FIG. 1 of the drawing.

Test tie F was constructed from the same materials as test ties D and E except that a single sheet of corrugated steel about 20 inches wide was cut and folded on parallel longitudinal lines to form a trough with bottom 8 inches wide and two sides 6 inches high. The bottom was then cut back from the ends to leave a central bottom portion about 36 inches long corresponding to the distance between the facing bottom edges of the inner ends of the foam blocks set 59 inches apart center-to-center. The side panels were lag-bolted to the foam blocks, and the ends of the side panels were trimmed back like those of test tie E.

The resuling test ties were weighed and tested in the manner described in Example 1 for resistance to vertical lift-out from standard railroad ballast, with results shown in Table II.

Table II

| Test Tie | Actual Wt., lbs | Lift-Out Force, lbs |
|---|---|---|
| 2.D | 39.75 | 280 |
| 2.E | 39.5 | 260 |
| 2.F | 40.5 | 326 |

The greater lift-out force required in the case of test tie 2F reflects, of course, the weight of ballast held in the trough between the foam blocks because of the bottom sheet member of the connecting web system. The lift-out forces required for the bottomless ties 2D and 2E compare favorably with that of the much heavier wood tie in the preliminary test described in connection with Example 1.

EXAMPLE 3

This example illustrates the installation and use of the novel crossties in actual railway service.

Using materials and mode of construction described in Example 2, 23 ties were made according to the description of test tie E and another 23 ties were made according to the description of test tie F.

A portion of an operating railway line was selected which comprises jointed rails spiked to wood ties set in broken rock ballast on the roadbed, all of common design. A section of rails was taken up and the wood ties were removed. The 46 test ties E and F were laid in place in the roadbed. Tie plates were laid on top of the rail support blocks of the new ties, the rails were replaced and respiked, the spikes being easily and securely driven into the foam plastic blocks. Ballast was placed around the ties and power tamped in conventional fashion, and fresh ballast was applied and dressed to the top of the ties, between the rails and onto the shoulders of the roadbed.

The track, of which the new tie section is a part, is in daily use for movement and temporary storage of trains of loaded and empty coal cars of 100-ton capacity having gross weight of about 135 tons each when loaded.

After about seven months from the installation of the new ties, the entire track (including the wood tie portion and the new synthetic tie portion) was raised and retamped as part of a regular routine track maintenance program. No difficulties were encountered because of the new ties before, during or after the retamping. After about nine months from installation, the new ties appear to be unchanged. Grade and guage are holding and the spikes are tight. During this period, the ties and track system were exposed to weather changes from subfreezing winter to heat of summer and from snow to rain to drought, all without any detectable adverse effect.

What is claimed is:

1. In a railroad crosstie, adapted to support rails on a railway roadbed, comprising at least two rail-support blocks and a web system interconnecting and fastened to such blocks, each rail-support block having a base face and a rail face, each such block being adapted to support a rail and to receive rail fastening devices on its rail face, the rail-support blocks being separated from each other by distances corresponding to the distances separating rails to be carried by that crosstie, the interconnecting web system comprising at least one self-supporting rigid sheet component adapted to be buried in particulate ballast when the crosstie is in place in the roadbed, said sheet component having means to interact mechanically with the ballast, the improvement wherein the said self-supporting rigid sheet component is composed of non-metallic material.

2. The improvement according to claim 1 wherein the rail-support blocks have aligned side faces, the interconnecting web system comprises two of said self-supporting rigid sheet components of non-metallic material in the form of two side panels of non-metallic, self-supporting rigid sheets each of which sheets interfaces with one set of aligned side faces of the rail-support blocks and is fastened to such side faces.

3. A railroad crosstie, adapted to support rails on a railway roadbed, comprising at least two rail-support blocks and a web system interconnecting and fastened to such blocks, each rail-support block having a base face and a rail face, each such block being adapted to support a rail and to receive rail fastening devices on its rail face, the rail-support blocks being separated from each other by distances corresponding to the distances separating rails to be carried by that crosstie, the interconnecting web system comprising at least one self-supporting rigid sheet component adapted to be buried in particulate ballast when the crosstie is in place in the roadbed, said sheet component having means to interact mechanically with the ballast, wherein the rail-support blocks have aligned side faces and rectangular cross-section transverse of the crosstie and the interconnecting web system comprises two side panels of non-metallic, self-supporting rigid sheet each of which sheets interfaces with one set of aligned side faces of the rail-support blocks and is fastened to such side faces.

4. In a railroad crosstie, adapted to support rails on a railway roadbed, comprising at least two rail-support blocks and a web system interconnecting and fastened to such blocks, each rail-support block having a base face and a rail face, each such block being adapted to support a rail and to receive rail fastening devices on its rail face, the rail-support blocks being separated from each other by distances corresponding to the distances separating rails to be carried by that crosstie, the interconnecting web system comprising at least one self-supporting rigid sheet component adapted to be buried in particulate ballast when the crosstie is in place in the roadbed, said sheet component having means to interact mechanically with the ballast, the improvement wherein the rail-support blocks have aligned side faces, the interconnecting web system comprises two of said self-supporting rigid sheet components in the form of two side panels of self-supporting rigid sheet and also comprises a bottom panel lying in a plane parallel to the base faces of the rail-support blocks and having side edges secured to the side panels, the bottom panel running lengthwise of the crosstie between but not beneath the rail-support blocks.

5. A railroad crosstie, adapted to support rails on a railway roadbed, comprising at least two rail-support blocks and a web system interconnecting and fastened to such blocks, each rail-support block having a base face and a rail face, each such block being adapted to support a rail and to receive rail fastening devices on its rail face, the rail-support blocks being separated from each other by distances corresponding to the distances separating rails to be carried by that crosstie, the interconnecting web system comprising at least one self-supporting rigid sheet component adapted to be buried in particulate ballast when the crosstie is in place in the roadbed, said sheet component having means to interact mechanically with the ballast, wherein the rail-support blocks are composed of cellular high density polyethylene having average bulk density from about 15 to about 50 pounds per cubic foot and have aligned longitudinally corrugated side faces, and the interconnecting web system comprises two side panels of self-supporting rigid sheet metal each of which metal panels is corrugated longitudinally to match the interfacing corrugations on the side faces of the said rail-support blocks and is fastened to such side faces, and the interconnecting web system also comprises a bottom panel lying in a plane parallel to the base faces of the rail-support blocks and having side edges secured to the side panels, the bottom panel running lengthwise of the crosstie between but not beneath the rail-support blocks.

* * * * *